United States Patent [19]

Hoffman et al.

[11] Patent Number: 4,526,510

[45] Date of Patent: Jul. 2, 1985

[54] DOUBLE-WALLED CENTRIFUGAL FAN SCROLL AND SYSTEM OF OPERATION

[76] Inventors: Joseph H. Hoffman, 15 Hemlock St., Norwood, Mass. 02062; Steven R. Thayer, 97 Mill St., Weymouth, Mass. 02188

[21] Appl. No.: 472528

[22] Filed: Mar. 7, 1983

[51] Int. Cl.[3] ..... F04D 29/58; F04B 23/04

[52] U.S. Cl. ..... 415/175; 415/201; 415/219 C; 417/428; 60/646

[58] Field of Search ..... 415/175, 144, 204, 127, 415/61, 126, 219 C, 200, 201, 50, 176; 417/366, 417/368, 428, 2; 60/646, 657

[56] References Cited

U.S. PATENT DOCUMENTS

| | | | |
|---|---|---|---|
| 829,791 | 8/1906 | Junggren | 60/679 |
| 1,541,834 | 6/1925 | Losel | 415/108 |
| 1,634,304 | 7/1927 | Schleyer | 415/204 |
| 1,773,909 | 8/1930 | Korb | 415/112 |
| 2,265,758 | 12/1941 | Klosson | 415/201 |
| 2,369,795 | 2/1945 | Planiol et al. | 415/200 |
| 2,844,100 | 7/1958 | Heinicke | 415/213 R |
| 3,149,574 | 9/1964 | Mill | 415/219 R |
| 3,174,682 | 3/1965 | Wilfert et al. | 415/200 |
| 3,312,389 | 4/1967 | Matsui | 415/119 |
| 3,560,104 | 2/1971 | Neale | 415/83 |
| 3,608,088 | 9/1971 | Dorman et al. | 415/204 |
| 3,856,431 | 12/1974 | Tucker | 415/219 |
| 3,880,549 | 4/1975 | Schrieken | 415/95 |
| 4,207,025 | 6/1980 | Reynolds et al. | 415/200 |

FOREIGN PATENT DOCUMENTS

| | | | |
|---|---|---|---|
| 0176218 | 2/1953 | Fed. Rep. of Germany | 415/61 |

*Primary Examiner*—Robert E. Garrett
*Assistant Examiner*—H. Edward Li
*Attorney, Agent, or Firm*—Fisher, Crampton, Groh & McGuire

[57] ABSTRACT

A hot gas centrifugal fan is constructed with a scroll part comprising spaced-apart walls 16 and 18 to define a hot gas passage 22 therebetween to which hot gas is conveyed when the fan is in a non-operating condition to hold the fan temperature sufficiently high to avoid unacceptable vibration brought on by thermal distortion of the fan wheel upon a re-start of the fan.

6 Claims, 4 Drawing Figures

DOUBLE-WALLED CENTRIFUGAL FAN SCROLL AND SYSTEM OF OPERATION

BACKGROUND OF THE INVENTION

This invention pertains to the art of large centrifugal fans which operate in elevated temperature ranges.

Some hot gas handling fans are used in arrangements in which two or more of the fans are arranged in a parallel flow arrangement. One example of the use of fans in such a parallel arrangement would be in a gas recirculation system in connection with an electric utility boiler and furnace where a portion of the flue gas from the furnace is recirculated back to the lower part of the furnace for the purpose of maintaining mass flow through the boiler to better control steam temperature. Under some load conditions of the power plant, only one of the two fans may be operating. However, with a changed fan load requirement, such as an increase, the additional fan will be required to operate. Since bringing the additional fan on line with little or no advance warning is often necessary, it is helpful if it is held at a temperature sufficiently close to the temperature of the hot gas which it is to handle, so as to avoid unacceptable vibration which can occur if the wheel of the fan is thermally distorted by heating the wheel too fast by the high-temperature hot gas. Other examples in which multiple fans in parallel handle high-temperature dirty gas, and where the fans are selectively operated and it is desirable to maintain the non-operating fans at a temperature higher than ambient, are found in certain industrial processing such as coal shale processing and pelletizing.

It is the aim of this invention to provide a large centrifugal fan scroll construction, and system, in which any non-operating hot gas fan of a number of hot gas fans is maintained at an elevated temperature to permit rapid start-up of operation.

SUMMARY OF THE INVENTION

In accordance with the invention the hot gas fan has a spiral-shaped scroll assembly having a radially inner wall and a radially outer wall spaced apart from each other in a radial direction to provide a hot gas passage therebetween extending for most of the length of the spiral shape, with the hot gas passage having both inlet and outlet means to provide for circulation of hot gas therethrough to thus heat the housing and, in turn, the wheel and shaft of the fan.

Further, in accordance with the invention, a system is provided with means for directing a part of the main flow of the hot gas being handled by operating fans to the inlet of the hot gas passage of any non-operating fan, and for returning the flow delivered to the hot gas passage back to the main flow of hot gas.

DESCRIPTION OF THE PREFERRED EMBODIMENTS

Figure 1:
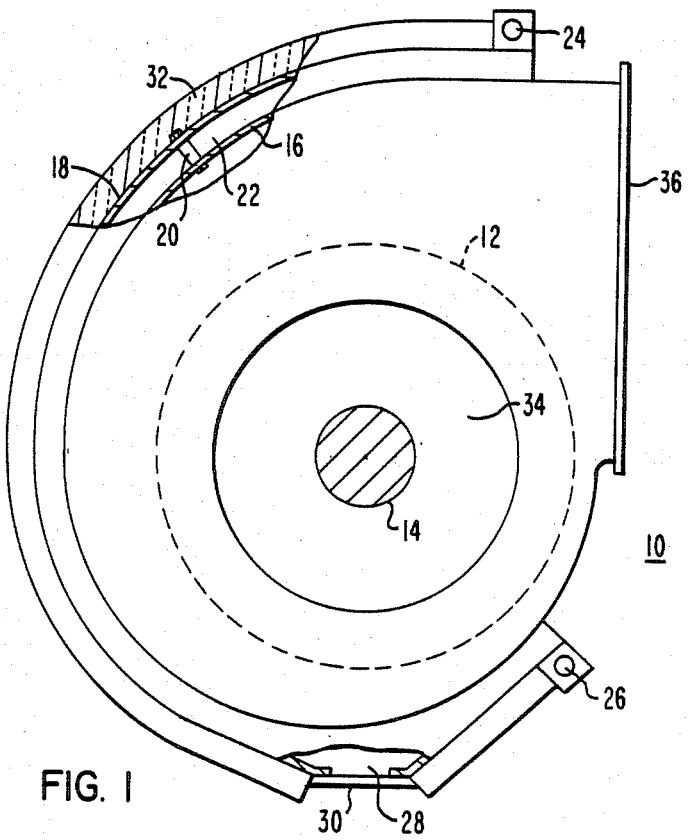
FIG. 1 is a partly broken side view of a fan having one construction according to the invention.

Referring to FIG. 1, a fan according to the invention includes the housing generally designated 10, which is generally scroll shaped contains a wheel 12 supported by shaft 14. The spiral-shaped scroll part of the housing comprises a radially inner wall 16 and a radially outer wall 18 spaced apart by strategically located pipe braces 20 so that a hot gas passage 22 is defined between the two walls. This hot gas passage extends for most of the length of the scroll of the fan and has an inlet opening 24 at the one end of the hot gas passage and an outlet opening 26 at the other end of the passage. Since most of the hot gas to be handled by a fan of this type includes some particulates entrained therein, that part of the hot gas passage located at the bottom of the fan has an enlarged cross section to permit the accumulation, as at 28, of the particulates, and a clean-out access panel 30 is provided at this location.

At least the major part of the length of the scroll is encompassed by thermal insulation 32 and in most cases it will be preferable that the entire exterior of the fan housing be covered with thermal insulation.

Figure 2:
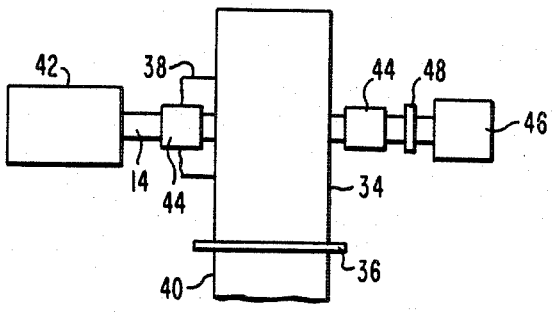
FIG. 2 is a partly diagrammatic top view of a single fan with a driving motor and turning gear arrangement.

Both the inlet 34 and the outlet 36 have duct means 38 and 40, respectively, (FIG. 2) connected thereto for conveying the main flow of gas when the fan is operating. FIG. 2 also shows the main drive motor 42 which drives the shaft 14 and accordingly the wheel 12 when the fan is operating. The shaft 14 is supported in bearings 44 located on the opposite sides of the housing, and a turning gear motor 46 is also connected to the shaft 14 through a clutch 48 for use when the fan is not operating, and to provide for a relatively slow rotation of the wheel to maintain a more or less uniform temperature in the housing around the wheel and shaft.

Figure 3:
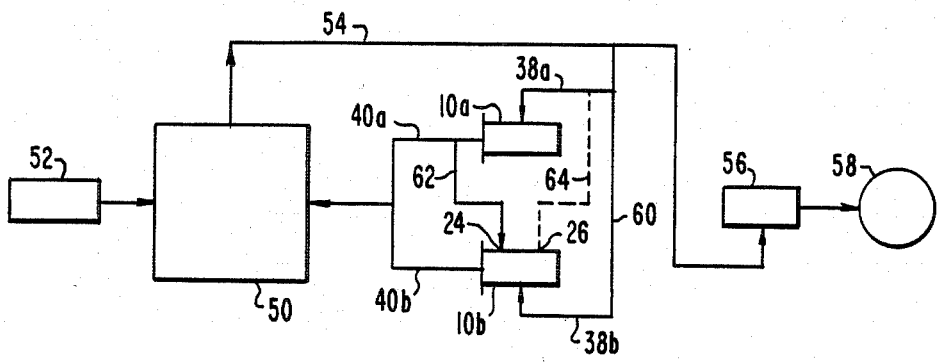
FIG. 3 is a diagrammatic view providing an example of a flow arrangement for a power plant having a gas recirculation system.

A system arrangement in which a pair of hot gas recirculation fans 10*a* and 10*b* (FIG. 3) serve the furnace 50 of a utility boiler is illustrated schematically in FIG. 3. The overall system arrangement includes a forced draft fan 52 which supplies ambient air to the furnace 50, the main flow of flue gas exiting the furnace through line 54 which conveys the main flow to an induced draft fan 56 which discharges the flue gas ultimately to the stack 58. Part of the flue gas is tapped off from the line 54 by line 60 which connects to the inlets of the two hot gas fans 10 through the inlet lines 38*a* and 38*b*. The hot gas is circulated back to the furnace through the main outlet lines 40*a* and 40*b* of the hot gas fans.

Under some load conditions both hot gas recirculation fans will be operating. Under some reduced fan load requirements, one of the fans is placed in a non-operating condition. In the case of FIG. 3, it will be assumed that the fan 10*a* operates while fan 10*b* is not operating. Piping means 62 connects the main outlet flow line 40*a* of the fan 10*a* with the inlet 24 of the hot gas passage in fan 10*b*. The outlet 26 from the hot gas passage is connected by piping means indicated by the dash line 64 to the main flow inlet line 38*a* for the fan 10*a*. Thus, with fan 10*a* operating and 10*b* dormant, the flow through the hot gas passage of the fan 10*b* is effected by the differential in pressure between the inlet and outlet of the fan 10*a*. While FIG. 3 shows an arrangement in which the fan 10*b* would always be the one in a non-operating condition when only one fan is required to be operated, a reverse set of piping connections corresponding to lines 62 and 64 can be provided with suitable dampers in the various lines to obtain the particular flow arrangement desired.

Figure 4:
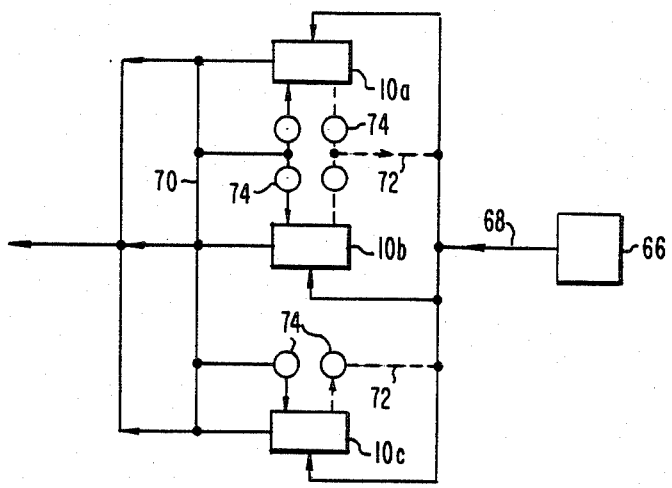
FIG. 4 is a diagrammatic view of a system including three fans in parallel for handling hot gas from a process.

FIG. 4 shows an example in which three parallel hot gas fans 10*a*, and 10*c* handle hot gas from an unspecified industrial process represented as taking place at 66. The inlets of each of the fans is connected to the line 68 into which the hot gas from the process is discharged. The main outlet line of each of the fans is connected to a common line 70 which, in turn, is connected to each of the inlets of the hot gas passages of the three fans. Correspondingly, the outlets of each of the hot gas passages is connected to the main flow inlet lines as indicated by the dash lines 72. Both the inlet lines through the hot gas passages and the outlet lines therefrom are provided with suitable damper means, indicated by the circles 74, to control the flow to the hot gas passages in accordance with the operating or non-operating condition of any of the fans. Thus, one operating fan may serve two non-operating fans, or even more, depending upon the number of fans involved and what is considered to provide the best operating system. In that connection, it is noted that while FIG. 4 shows only three fans in parallel, it is contemplated that in some future processes, as many as twelve fans in parallel may be provided.

We claim:

1. For a centrifugal fan operating at least part of the time in an elevated temperature range of, say, above 600° F. (349° C.), an improvement comprising:

a spiral-shaped scroll assembly having a radially inner wall and a radially outer wall shaped apart from each other in a radial direction to define a hot gas passage therebetween extending for most of the length of the spiral shape, means controlling hot gas flow for said hot gas passage in a manner that said hot gas passages receives hot gas only when the fan is in a non-operating condition, and at a temperature sufficiently close to said elevated temperature range to avoid unacceptable vibrations upon start-up of the fan from the non-operating condition;

inlet means for admitting hot gas to one end of said hot gas passage; and outlet means for discharging hot gas from the other end of said passage.

2. For a fan in accordance with claim 1 including:

thermal insulation encompassing the exterior of at least said hot gas passage.

3. For a fan according to claim 1 including:

particulate clean-out access means at the lower portion of said hot gas passage.

4. For a fan according to claim 1 including:

said inlet means is located at the end of said passage at an elevated height relative to said other end of said passage.

5. In a system including at least a pair of centrifugal fans having main inlets and outlets and operating selectively, or together, at least part of the time in an elevated temperature range of, say above 600° F. (349° C.), to convey a main flow of gas of said elevated temperature, an improved arrangement for maintaining any one of two or more of said fans in a non-operating condition at a temperature sufficiently close to said elevated temperature range to avoid unacceptable vibrations upon start-up from a non-operating condition:

each said fan having double-scroll wall means defining a hot gas passage extending for most of the scroll length, and an inlet and outlet to each said hot gas passage; and means for directing a part of said main flow to the inlet of the hot gas passage of any non-operating fan, and for returning said delivered flow from the outlet of the hot gas passage to said main flow.

6. In a system according to claim 5 wherein:

said directing means includes piping means connecting said main outlets of said fans to said hot gas passage inlets, and connecting said hot gas passage outlets to said main inlets; and means for controlling the flow through said piping means in accordance with the operating or non-operating condition of each fan to deliver hot gas to the hot gas passages of any non-operating fan from an operating fan, and to return said delivered gas from said non-operating fan to said operating fan.

* * * * *